US007381119B2

(12) United States Patent
Chang

(10) Patent No.: US 7,381,119 B2
(45) Date of Patent: Jun. 3, 2008

(54) FIXTURE FOR GRINDING MACHINES

(75) Inventor: Chun-Yi Chang, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,672

(22) Filed: Sep. 8, 2006

(65) Prior Publication Data

US 2007/0155288 A1 Jul. 5, 2007

(30) Foreign Application Priority Data

Jan. 5, 2006 (CN) ..... 2006 1 0032764

(51) Int. Cl.
*B23B 31/30* (2006.01)

(52) U.S. Cl. ..... 451/388; 451/390; 451/391

(58) Field of Classification Search ..... 451/365, 451/384, 386, 388, 390, 391
See application file for complete search history.

(56) References Cited

U.S. PATENT DOCUMENTS

| | | | | |
|---|---|---|---|---|
| 1,683,250 | A * | 9/1928 | Hitchcock | 451/388 |
| 4,183,545 | A * | 1/1980 | Daly | 279/3 |
| 4,603,466 | A * | 8/1986 | Morley | 269/21 |
| 2002/0015239 | A1 * | 2/2002 | Yamashita et al. | 359/819 |

* cited by examiner

*Primary Examiner*—Jacob K. Ackun, Jr.
(74) *Attorney, Agent, or Firm*—Jeffrey T. Knapp

(57) ABSTRACT

A fixture for grinding machines includes a first base (10) and a second base (20). The first base has a first surface (12) which defines a first holding groove (11). The first base defines a plurality of first suction holes (13) on the first surface. The second base has a second surface (22) which defines a second holding groove (21) corresponding to the first holding groove. The second base defines a plurality of second suction holes (23) on the second surface.

12 Claims, 4 Drawing Sheets

FIXTURE FOR GRINDING MACHINES

FIELD OF THE INVENTION

The present invention generally relates to fixtures for grinding machines, and more particularly to a fixture for grinding machines which does not require workpieces to be fixed in position by gluing before being ground, or such like.

DESCRIPTION OF RELATED ART

Many kinds of workpieces need to be ground to have proper shapes before use. For example, lenses used in digital camera modules are ground to be round for being installed into barrels.

Workpieces such as lenses used in digital camera modules are very small, therefore it is inefficient to grind the workpieces one by one and a plurality of workpieces may be ground, each workpiece is aligned with all other workpieces and held in contact with other workpieces. Adhesives such as ultraviolet (UV) glue can be used to glue all workpieces together in a column. The column formed by the workpieces is secured in a fixture of a grinding machine using adhesive, and the column is ground to be a cylinder by the grinding machine. After grinding the ultraviolet glue is dissolved, and the cylinder is thus disassembled to form a plurality of round workpieces, and the workpieces may then be taken away from the fixture.

However, gluing the workpieces and dissolving the adhesive uses a lot of time, and the adhesive adds to total cost. Additionally, when the adhesive is dissolved, some workpieces may be stained by the adhesive, and some remaining adhesive may glue some workpieces to the fixture or other workpieces, thus slowing operation.

Therefore, a new fixture for grinding machines is desired in order to overcome the above-described shortcomings.

SUMMARY OF THE INVENTION

In a present embodiment thereof, a fixture for grinding machines includes a first base and a second base. The first base has a first surface, which defines a first holding groove. The first base defines a plurality of first suction holes on the first surface. The first base includes a first pushing component. The first pushing component includes a first pushing board end a first pushing pole. The first pushing board is movably installed in the first holding groove. The second base has a second surface, which defines a second holding groove corresponding to the first holding groove. The second base defines a plurality of second suction holes on the second surface.

Other advantages and novel features will become more apparent from the following detailed description when taken in conjunction with the accompanying drawings.

BRIEF DESCRIPTION OF THE DRAWINGS

Many aspects of the fixture can be better understood with reference to the following drawings. The components in the drawings are not necessarily drawn to scale, the emphasis instead being placed upon clearly illustrating the principles of the lens module. Moreover, in the drawings, like reference numerals designate corresponding parts through out the several views.

DETAILED DESCRIPTION OF THE INVENTION

Figure 1:
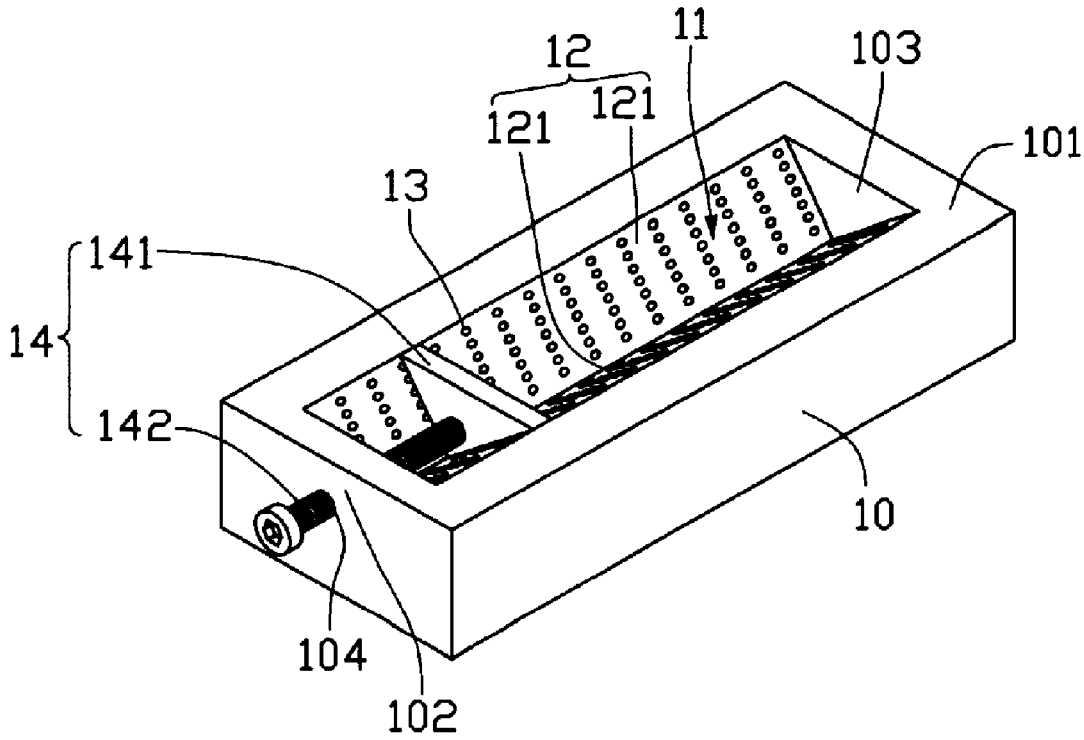
FIG. 1 is an isometric view of a first base of a fixture in accordance with a preferred embodiment of the present invention.
Figure 2:
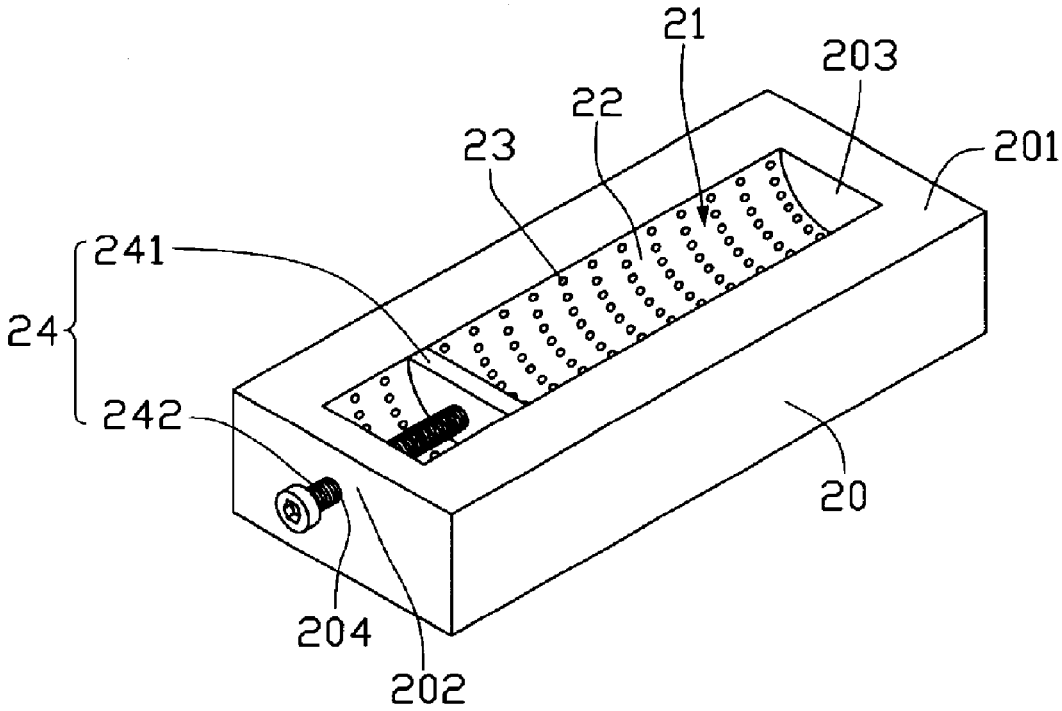
FIG. 2 is an isometric view of a second base of the fixture in accordance with the preferred embodiment of the present invention.
Figure 3:
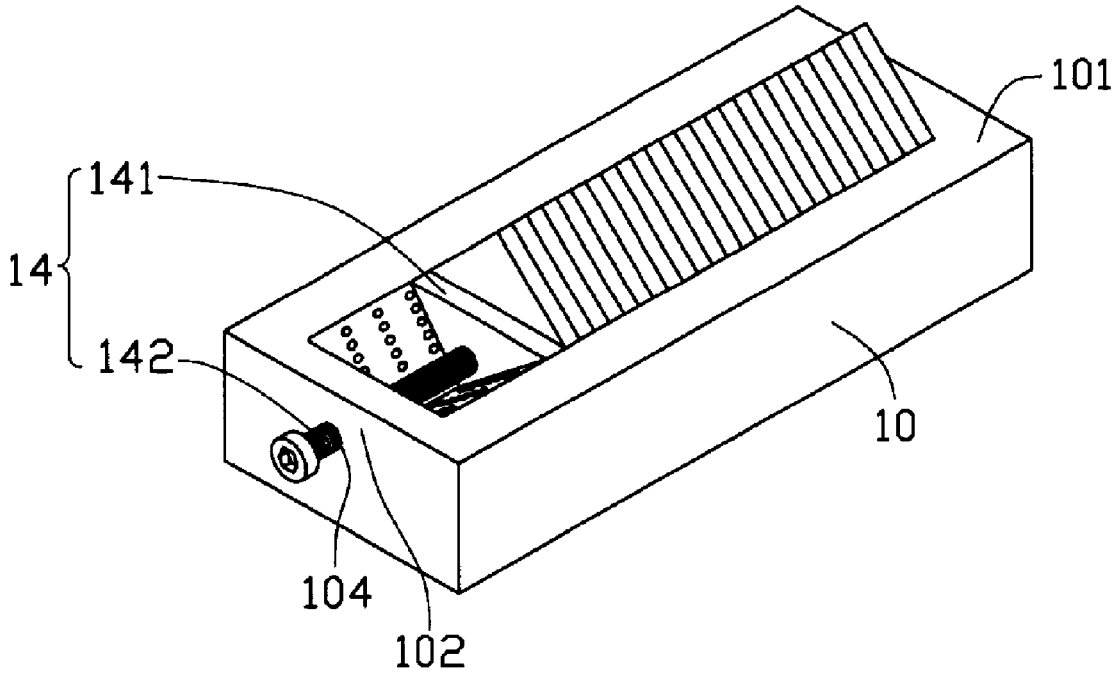
FIG. 3 is an isometric view of some workpieces which need to be ground placed in the first base of the fixture in accordance with the preferred embodiment of the present invention.

Referring now to the drawings in detail, FIG. 1, FIG. 2 and FIG. 3 show all components of a fixture for grinding machines in accordance with a preferred embodiment of the present invention. The fixture includes a first base 10 and a second base 20. The fixture cooperates with an air pump (not shown)to secure some workpieces (not labeled) such as lenses, and a grinding machine (not shown)grinds the workpieces to be round.

Referring now to FIG 1, the first base 10 is approximately a cuboid. The first base 10 includes a first working surface 101 and defines a first holding groove 11 on the first working surface 101. The first holding groove 11 has a triangular cross section. A first surface 12 corresponding to the first holding groove 11 is formed in the first base 10, the first surface 12 includes two inclined planes 121. The two inclined planes 121 are perpendicular to each other, and each inclined plane 121 forms an angle of 45 degrees with the first working surface 101, a workpiece that needs to be ground can be engaged in the first holding groove 11. A first installing wall 102 is formed on one end of the first holding groove 11, a first confining wall 103 is formed on the other end of the first holding groove 11, and the first installing wall 102 is parallel to the first confining wall 103. The first base 10 defines a first installing hole 104, the first installing hole 104 runs through the first installing wall 102, and screw thread (not shown) is formed in the first installing hole 104. The first base 10 also defines a plurality of first suction holes 13 on each inclined plane 121. A diameter of each first suction hole 13 is smaller than a thickness of each workpiece that needs to be ground, and all first suction holes 13 can communicate with the air pump.

The first base 10 also includes a first pushing component 14, the first pushing component 14 includes a first pushing board 141 and a first pushing pole 142. The first pushing board 141 is a smooth triangular board and has a shape that coincides with the cross section of the first holding groove 11. Screw thread (not labeled) corresponding to the screw tread fanned in the first installing hole 104 is formed in a surface of the first pushing pole 142. The first pushing board 141 is installed in the first holding groove 11, and the first pushing pole 142 is connected with the first pushing board 141 via the first installing hole 104. When the first pushing pole 142 rotates in the first installing hole 104, the first pushing board is driven to slide along the first holding groove 11. Additionally, a plurality of grooves similar to the first holding groove 11 can be defined on the first working surface 101. Degree of the angle formed by the two inclined planes can be changed to correspond with the workpieces.

Referring now to FIG 2, the second base 20 is approximately a cuboid. The second base 10 includes a second working surface 201 corresponding to the first working surface 101 and defines a second holding groove 21 corresponding to the first holding groove 11 on the second working surface 201. A second surface 22 corresponding to the second holding groove 21 is formed in the second base 20. The second surface 22 is a cylinder, a ground portion of a partially ground workpiece can be engaged with the second holding groove 21. A second installing wall 202 is formed on one end of the second holding groove 21, a second confining wall 203 is formed on another end of the second holding groove 21, and the second installing wall 202 is parallel to the second confining wall 203. The second base 20 defines a second installing hole 204, the second installing hole 204 runs Through the second installing wall 202, and screw thread (not shown) is formed in the second installing hole 204. The second holding groove 21 has a semicircular cross section, and a diameter of the semicircular cross section is equal to a diameter of ground workpieces, partially ground workpieces can be engaged in the second holding groove 21. The second base 20 also defines a plurality of second suction holes 23 on the second surface 22. A diameter of each second suction hole 23 is smaller than a thickness of each partially ground workpiece, and all second suction holes 23 van be connected with the air pump.

The second base 20 also includes a second pushing component 24, the second pushing component 24 includes a second pushing board 241 and a second pushing pole 242. The second pushing board 241 is a smooth semicircular board and Ms a shape that coincides with the cross section of the second holding groove 21. Screw thread (not labeled) corresponding to the screw thread formed in the second installing hole 204 is formed in a surface of the second pushing pole 242. The second pushing board 241 is installed in the second holding groove 21, and the second pushing pole 142 is connected with the second pushing board 241 via the second installing hole 204. When the second pushing pole 242 rotates in the second installing hole 204, the second pushing board is driven to slide along the second holding groove 21. Additionally, a plurality of grooves similar to the second holding groove 21 can be defined on the second working surface 201.

Also referring to FIG 3, during use a whole piece of material such as glass (not shown) is cut into a plurality of rectangular workpieces (not labeled), the workpieces are placed into the first holding groove 11. After the workpieces are placed properly, an air pump (not shown) is connected with the first suction holes 13 and turned on. The workpieces are attracted in the first holding groove 11, two adjacent sides of each workpiece are attracted by the pump to adhere to the two inclined planes 121, thus each workpiece is aligned with all other workpieces. The first pushing pole 142 is rotated in the first installing hole 104, the first pushing board 141 is then pushed to slide to the first confining wail 103 along the first holding groove 11, and the workpieces are pushed to slide to the first confining wall 103 along the first holding groove 11 until the workpieces are pressed between the first pushing board 141 and the first confining wall 103. In this way, the workpieces are secured in the first holding groove 11 and each workpiece is pressed close to other workpieces adjacent to itself, thus the workpieces are prevented from moving when being ground.

A grinding machine (not shown) is used to grind an exposed portion of each secured workpiece to be round. In this way each workpiece is ground to have a shape formed by a first portion (not labeled) and a second portion (not shown), the first portion is a triangle and the second portion is a semicircle whose bottom coincides with the bottom of the first portion. The second portion is exposed out of the first holding groove IA, and the first portion is engaged with the first holding groove 11.

Figure 4:
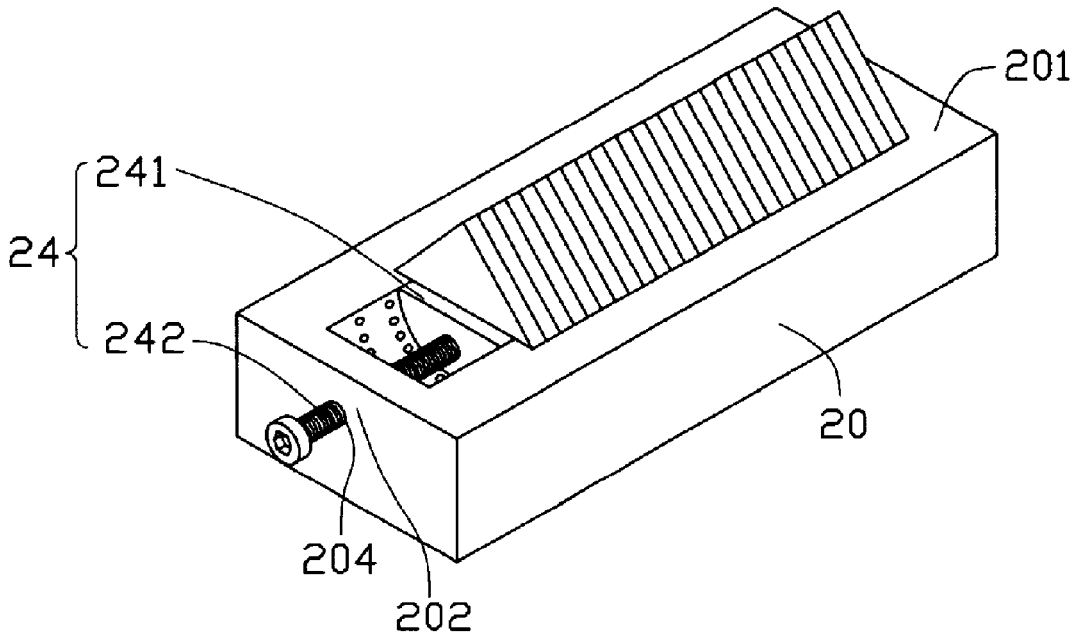
FIG. 4 is an isometric view of the partially ground workpieces and placed in the second base of the fixture in accordance with the preferred embodiment of the present invention.

Also referring to FIG 4, After each workpiece is ground, the second base 20 is covered on the first base 10, and the second portion of each workpiece is engaged with the second holding groove 21. The air pump is turned off and separated from the first suction holes 13. The first pushing pole 142 is rotated reversedly, then the first pushing board 141 is driven to slide to the first installing wall 102 along the first holding groove 11, and the workpieces are released.

The air pump is connected with the second suction holes 23. After the second portion of each workpiece is engaged with the second holding groove 21 and each workpiece is aligned with all other workpieces, the air pump is turned on, thus the workpieces are attracted in the second hole 21. The second pushing pole 242 is rotated in the second installing hole 204, the second pushing board 241 is then pushed to slide to the second confining wall 203 along the second holding groove 21, and the workpieces are pushed to slide to the second confining wall 203 along the second holding groove 21 until the workpieces are pressed between the second pushing board 241 and the second confining wall 203. In this way, the workpieces are secured in the second holding groove 21 and each workpiece is pressed close to other workpieces adjacent to itself, thus the workpieces is prevented from moving when being ground.

After all workpieces are secured and pressed properly, the first base 10 and the second base 20 are turned together. The first base 10 is taken away, thus the first portion of each workpiece is exposed from the second holding groove 21. The grinding machine is used to grind the first portion of each workpiece to be semicircular. In this way, each workpiece is ground to be round. The air pump is turned off, the second pushing pole 242 is rotated reversedly, the second pushing board 241 is driven to slide to the second installing wall 202 along the second holding groove 21, and the ground workpieces are released.

It is to be understood, however, that even though numerous characteristics and advantages of the present lens module with grating have been set forth in the foregoing description, together with details of the structure and function of the lens module with grating, the disclosure is illustrative only, and changes may be made in detail, especially in matters of shape, size, and arrangement of parts within the principles of the lens module with grating to the full extent indicated by the broad general meaning of the terms in which the appended claims are expressed.

What is claimed is:

1. A fixture for grinding machines, comprising:

a first base, the first base having a first surface, the first surface defining a first holding groove, the first holding groove being configured for receiving at least one pre-grinding workpiece, the first base including a first installing wall and a first confining wall, the first wall being formed on one end of the first holding groove and the first confining wall being formed on the other end of the first holding groove, the first base defining a first installing hole, the first installing hole running through the first installing wall, the first installing hole having a screw thread formed therein, the first base defining a plurality of first suction holes on the first surface, the first base including a first pushing component, the first pushing component including a first pushing board and a first pushing pole, the first pushing board being movably installed in the first holding groove; and a second base, the second base having a second surface, the second surface defining a second holding groove corresponding to the first holding groove, the second holding groove being configured for receiving at least one partially ground workpiece, the second base defining a plurality of second suction holes on the second surface.

2. The fixture as claimed in claim 1, further comprising an air pump cooperating with the first suction holes and the second suction holes to secure workpieces.

3. The fixture as claimed in claim 2, wherein a diameter of each first suction hole is smaller than a thickness of each workpiece, a diameter of each second suction hole is smaller than a thickness of each workpiece.

4. The fixture as claimed in claim 1, wherein screw thread corresponding to the screw thread fanned in the first installing hole is formed in a surface of the first pushing pole, the first pushing pole is connected with the first pushing board via the first installing hole.

5. The fixture as claimed in claim 1, wherein the second base includes a second installing wall and a second confining wall, the second wall is formed on one end of the second holding groove and the second confining wall is fanned on the other end of the second holding groove.

6. The fixture as claimed in claim 5, wherein the second base defines a second installing hole, the second installing hole runs through the second installing wall, and screw thread is formed in the second installing hole.

7. The fixture as claimed in claim 6, wherein the second base includes a second pushing component the second pushing component includes a second pushing board and a second pushing pole, the second pushing board is movably installed in the second holding groove and the second pushing pole drives the second pushing board to move.

8. The fixture as claimed in claim 7, wherein screw thread corresponding to the screw tread formed in the second installing hole is formed in a surface of the second pushing pole, the second pushing pole is connected with the second pushing board via the second installing hole.

9. The fixture as claimed in claim 1, wherein the first base defines a plurality of grooves similar to the first workpiece holding groove therein the second base defines a plurality of grooves similar to the second workpiece holding groove therein.

10. The fixture as claimed in claim 1, wherein the first holding groove has a V-shaped cross section.

11. The fixture as claimed in claim 1, wherein the second holding groove has a semicircular cross section.

12. The fixture as claimed in claim 11, wherein the first holding groove has a V-shaped cross section.

* * * * *